US007332668B2

(12) United States Patent
Hsieh

(10) Patent No.: US 7,332,668 B2
(45) Date of Patent: Feb. 19, 2008

(54) WAVETABLE AUDIO SYNTHESIS SYSTEM

(75) Inventor: Yu-Cheng Hsieh, Hsin-Chu (TW)

(73) Assignee: MediaTek Inc., Hsin-Chu (TW)

( * ) Notice: Subject to any disclaimer, the term of this patent is extended or adjusted under 35 U.S.C. 154(b) by 124 days.

(21) Appl. No.: 10/843,315

(22) Filed: May 12, 2004

(65) Prior Publication Data

US 2004/0231497 A1 Nov. 25, 2004

(30) Foreign Application Priority Data

May 23, 2003 (TW) ..... 92113987 A

(51) Int. Cl.
*G10H 1/06* (2006.01)
*G10H 7/00* (2006.01)

(52) U.S. Cl. ..... 84/622; 84/603; 84/604; 84/645; 379/88.23; 704/258

(58) Field of Classification Search ..... 84/622, 84/604, 603, 621, 616, 645; 710/52; 711/129; 379/88.23; 704/258
See application file for complete search history.

(56) References Cited

U.S. PATENT DOCUMENTS 4,622,877 A * 11/1986 Strong ..... 84/604
5,444,818 A * 8/1995 Lisle ..... 704/258
5,689,080 A * 11/1997 Gulick ..... 84/604
5,698,802 A * 12/1997 Kamiya ..... 84/604
5,734,119 A * 3/1998 France et al. ..... 84/622
5,744,739 A * 4/1998 Jenkins ..... 84/603
5,750,913 A * 5/1998 Kamiya ..... 84/625
5,753,841 A * 5/1998 Hewitt ..... 84/604
5,808,225 A * 9/1998 Corwin et al. ..... 84/622
5,847,304 A * 12/1998 Hewitt ..... 84/622
5,850,050 A * 12/1998 Isozaki et al. ..... 84/622
5,862,063 A * 1/1999 Thome et al. ..... 708/290
5,890,115 A * 3/1999 Cole ..... 704/258
5,901,333 A * 5/1999 Hewitt ..... 710/52
5,917,917 A * 6/1999 Jenkins et al. ..... 381/63
5,955,691 A * 9/1999 Suzuki et al. ..... 84/604
5,981,860 A * 11/1999 Isozaki et al. ..... 84/603
5,986,199 A * 11/1999 Peevers ..... 84/603
6,259,792 B1 * 7/2001 Lambrecht ..... 381/73.1
6,362,409 B1 * 3/2002 Gadre ..... 84/603
6,576,827 B2 * 6/2003 Tamura ..... 84/622

(Continued)

FOREIGN PATENT DOCUMENTS

WO WO0045545 8/2000

*Primary Examiner*—Lincoln Donovan
*Assistant Examiner*—Christina Russell
(74) *Attorney, Agent, or Firm*—Troxell Law Office, PLLC

(57) ABSTRACT

The present invention relates to an audio synthesis system for performing wavetable audio synthesis. The system comprises an instrument database, an analysis module, a memory, a judgment module, and a synthesis module. The instrument database is used for storing data of a first predetermined number of musical instruments. The analysis module is used for analyzing an inputted wavetable music to generate required data of a second predetermined number of musical instruments. The memory has a predetermined capacity for storing the required data of musical instruments to synthesize the wavetable music. The judgment module is used for judging whether the total amount of data of the second predetermined number of musical instruments exceeds the predetermined capacity. The synthesis module is used for synthesizing a digital music signal according to the instrument data stored in the memory.

6 Claims, 7 Drawing Sheets

U.S. PATENT DOCUMENTS 6,727,420 B2 * 4/2004 Suzuki et al. ..... 84/604
6,740,802 B1 * 5/2004 Browne, Jr. ..... 84/609
6,784,355 B2 * 8/2004 Gyoten et al. ..... 84/622
6,873,955 B1 * 3/2005 Suzuki et al. ..... 704/503
6,881,888 B2 * 4/2005 Akazawa et al. ..... 84/604
6,907,113 B1 * 6/2005 Holm et al. ..... 379/88.23
6,992,245 B2 * 1/2006 Kenmochi et al. ..... 84/622
7,038,119 B2 * 5/2006 Petef ..... 84/604
7,045,700 B2 * 5/2006 Hamalainen et al. ..... 84/645
7,105,737 B2 * 9/2006 Frangopol et al. ..... 84/615
2001/0045155 A1 * 11/2001 Boudet et al. ..... 84/645
2002/0134222 A1 * 9/2002 Tamura ..... 84/622
2004/0007120 A1 * 1/2004 Futamase et al. ..... 84/622
2004/0159219 A1 * 8/2004 Holm et al. ..... 84/645
2004/0209629 A1 * 10/2004 Virolainen et al. ..... 455/466
2004/0267541 A1 * 12/2004 Hamalainen et al. ..... 704/278
2005/0011341 A1 * 1/2005 Petef ..... 84/622
2005/0094638 A1 * 5/2005 Holm et al. ..... 370/389
2006/0005690 A1 * 1/2006 Jacobsson et al. ..... 84/603
2006/0060069 A1 * 3/2006 Sinisalo ..... 84/622
2006/0201312 A1 * 9/2006 Zinato ..... 84/622
2006/0211456 A1 * 9/2006 Holm et al. ..... 455/569.1

* cited by examiner

WAVETABLE AUDIO SYNTHESIS SYSTEM

BACKGROUND OF THE INVENTION

1. Field of the Invention

The present invention relates to an audio synthesis system, especially to an audio synthesis system applied in communication apparatuses.

2. Description of the Prior Art

Please refer to FIG. 1. FIG. 1 is a schematic diagram of a wavetable audio synthesis system 10 of the prior art. The wavetable audio synthesis system 10 of the prior art comprises a music database 11, an analysis module 12, a music generator 14, a digital/analog converter/amplifier 20, and a speaker 22. While the wavetable audio synthesis system 10 of the prior art synthesizes a music file 13, the music database 11 transmits the music file 13 to the analysis module 12, and the analysis module 12 selects music data and control commands (including the selection of the instruments, the setting of the volume and special efficacy, etc.) for the music file 13 to obtain the related analysis data of the music file 13.

The music generator 14 further comprises an instrument database 16 and a synthesis module 18. After obtaining the analysis data from the analysis module 12, the music generator 14 provides the required instrument data 24 from the instrument database 16 according to the analysis data. Then, the synthesis module 18 synthesizes the music. The synthesis module 18 synthesizes a pulse code modulation data according to the analysis data and the instrument data. The digital/analog converter/amplifier 20 converts the pulse code modulation data to an analog signal and amplifies the analog signal. Then, the amplified analog signal is outputted to the speaker 22 to give off sound.

In the wavetable audio synthesis system of the prior art, the basic instrument database includes 128 kinds of melodic instrument data and 47 kinds of percussion instrument data. In the wavetable audio synthesis system of the prior art, the 128 kinds of melodic instrument data and 47 kinds of percussion instrument data are generally stored in a non-volatile memory, such as read only memory (ROM), to be the instrument database. While synthesizing a piece of music, the synthesis module 18 takes the required instrument data out of the instrument database 16 to synthesize the music. Although this method can keep the quality of the synthesized music perfect, the manufacturing cost is usually high because of the large amount of memory required.

The low cost wavetable audio synthesis system of the prior art utilizes certain similarities among some of the instruments, thus storing only the most commonly used instrument data to reduce the cost of storing 128+47 instrument data.

Please refer to FIG. 2. FIG. 2 is a schematic diagram of a low cost wavetable audio synthesis system 30 of the prior art. The low cost wavetable audio synthesis system 30 of the prior art comprises a music database 11, an analysis module 12, a music generator 34, a digital/analog converter/amplifier 20, and a speaker 22. The method of this system 30 is to store M0 kinds of melodic instrument data and P0 kinds of percussion instrument data in a non-volatile memory of lower capacity, and the stored M0 and P0 instruments are representative instruments that are most commonly used. Because the memory capacity of M0+P0 kinds of instrument data is much smaller than that of 128+47 kinds of instrument data, the non-volatile memory of low capacity can be used to reduce cost.

As shown in FIG. 2, the low cost wavetable audio synthesis system 30 of the prior art takes the music file 13 out of the music database 11. Then, the analysis module 12 analyzes the music file 13 to generate an analysis data. The music generator 34 comprises a memory 36, an instrument replacement module 38, and a synthesis module 18. The instrument replacement module 38 performs an instrument replacement procedure after the music generator 34 obtains the analysis data from the analysis module 12. The instrument replacement module 38 contains a similarity comparison table of 128 kinds of melodic instruments and M0 kinds of representative instruments and a similarity comparison table of 47 percussion instruments and P0 representative instruments. By the instrument replacement procedure, the assigned instrument from the analysis data is changed to an instrument among the M0 and P0 kinds of representative instruments. The synthesis module 18 then takes the instrument data 26 out of the memory 36 to synthesize the music.

In the low cost wavetable audio synthesis system of the prior art, the required data of the memory 36 and the instrument replacement module 38 are stored in a non-volatile memory (a non-volatile memory is usually a ROM), so the kinds of instruments, which can be used, are specified. Therefore, there is a disadvantage of compromising the nature of the music due to the selection of the instruments.

SUMMARY OF THE INVENTION

The objective of the present invention is to provide an audio synthesis system of low cost design for performing a wavetable audio synthesis. The system, under the consideration of low cost, utilizes limited memory to hopefully reduce the inconsistency of the music caused by using different kinds of instruments and to achieve the objective of audio synthesis.

The audio synthesis system of the present invention comprises an instrument database, an analysis module, a memory, and a judgment module. The instrument database is used for storing data of a first predetermined number of musical instruments. The analysis module is used for analyzing an inputted music file to generate data of a second predetermined number of musical instruments included in the music file. The memory has a predetermined capacity for storing the required data of musical instruments for synthesizing the music file. The judgment module is used for judging whether the total amount of data of the second predetermined number of musical instruments exceeds the predetermined capacity of the memory. If no, the data of the second predetermined number of musical instruments is taken out from the instrument database to be stored in the memory. If yes, an instrument replacement procedure is performed, and the data of the second predetermined number of musical instruments is replaced by data of a third predetermined number of musical instruments. The total amount of data of the third predetermined number of musical instruments does not exceed the predetermined capacity. The judgment module further takes the data of the third predetermined number of musical instruments out of the instrument database to be stored in the memory. In addition, the synthesis module is used for synthesizing a digital music signal according to the instrument data stored in the memory.

The present invention utilizes random access memory (RAM) to access the required instrument data for synthesizing music. Because of using memory of low capacity, the cost of using a large amount of memory is reduced. The unit cost of RAM is usually higher, but because the required capacity is smaller, the storing cost is still cheaper than the prior art of FIG. 2 as a whole. Furthermore, the instrument data stored in the memory of the present invention is not constant; the present invention selects the most similar instrument data in accordance with the required instrument of the music. Therefore, the display quality of the synthesized music is improved a lot while the prior art uses non-volatile memory (e.g. ROM) to store constant instrument data.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
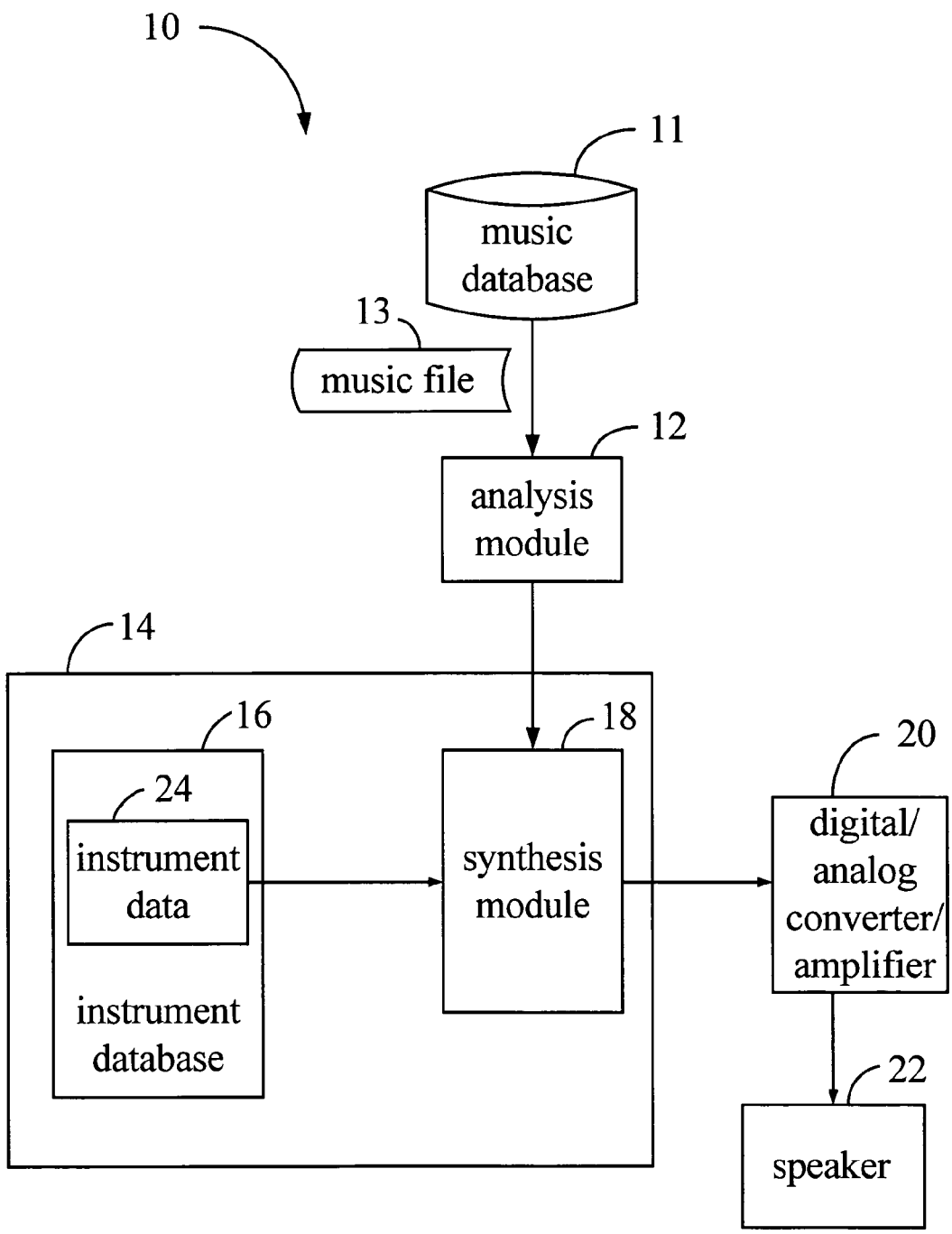
FIG. 1 (prior art)
FIG. 1 is a schematic diagram of a wavetable audio synthesis system 10 of the prior art.
Figure 2:
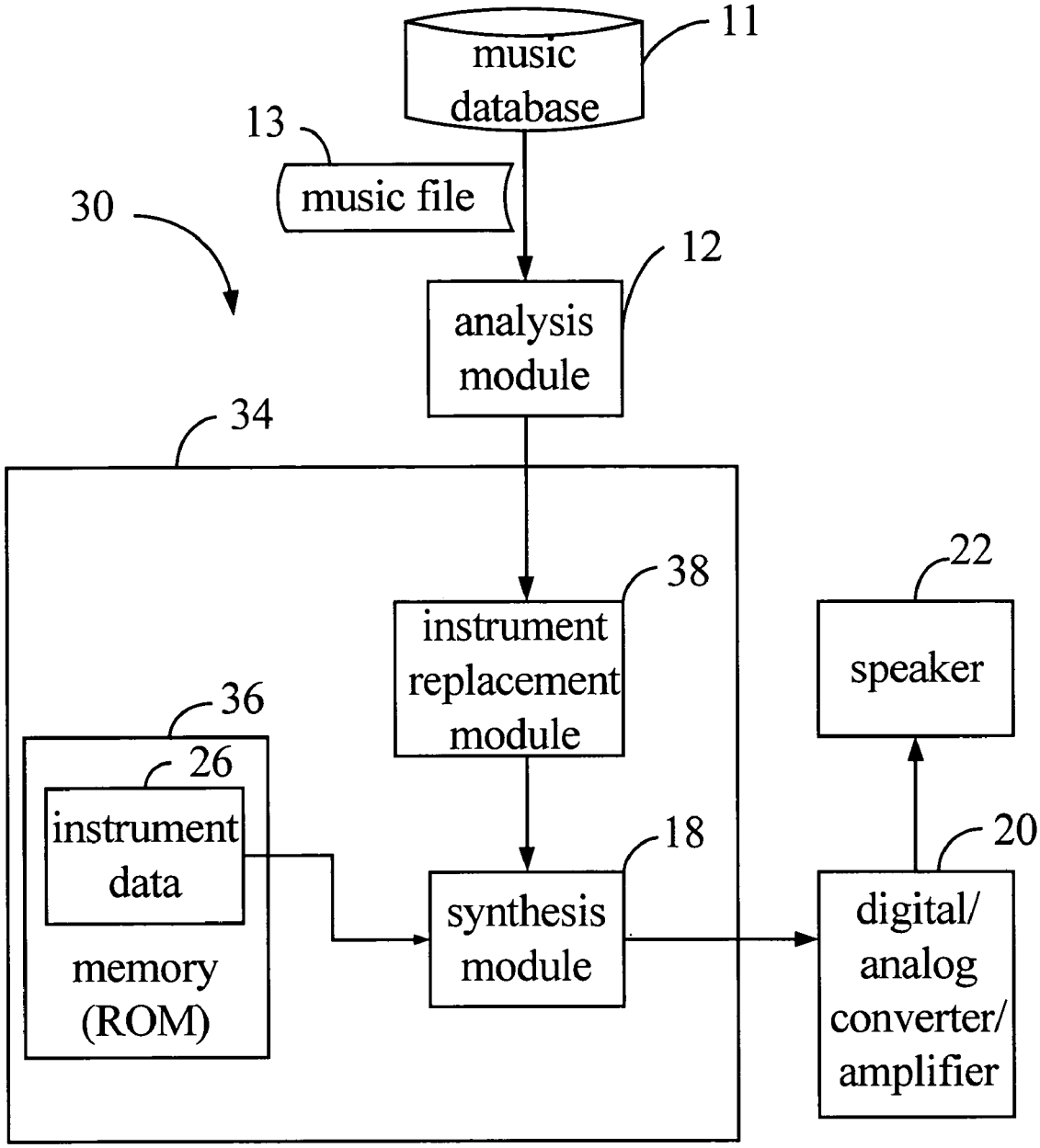
FIG. 2 (prior art)
FIG. 2 is a schematic diagram of a low cost wavetable audio synthesis system 30 of the prior art.
Figure 3:
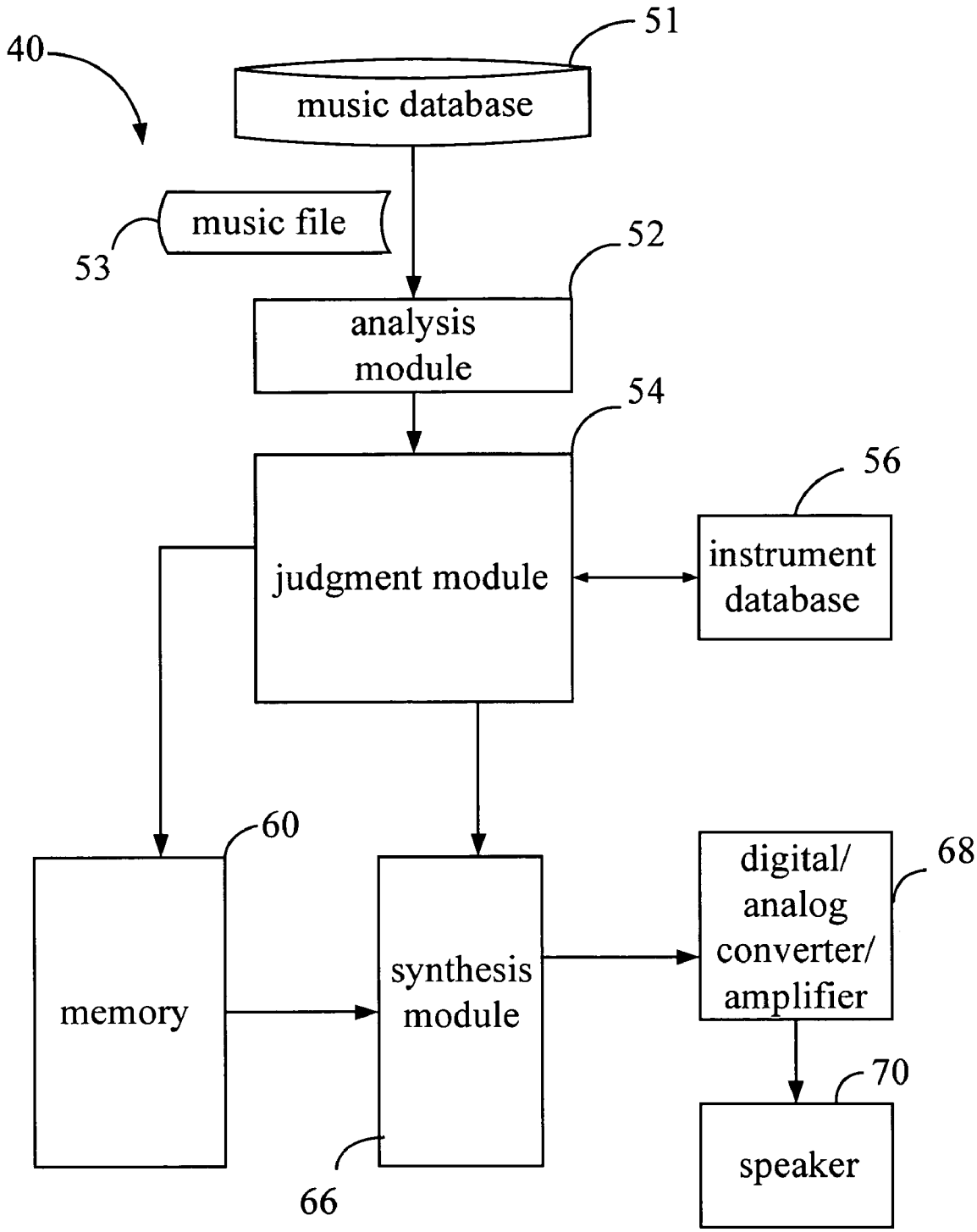
FIG. 3 is a schematic diagram of a wavetable audio synthesis system 40 of the present invention.

Please refer to FIG. 3. FIG. 3 is a schematic diagram of a wavetable audio synthesis system 40 of the present invention. The wavetable audio synthesis system 40 of the present invention comprises a music database 51, an analysis module 52, a judgment module 54, an instrument database 56, a memory 60, a synthesis module 66, a digital/analog converter/amplifier 68, and a speaker 70. First of all, the data stored in all kinds of database of the present invention is described in the following. The music database 51 stores a lot of music files. The instrument database 56 stores a predetermined number of instrument data, which comprises M1 kinds of melodic instrument data and P1 kinds of percussion instrument data. For example, the instrument database can comprise 128 kinds of melodic instrument data and 47 kinds of percussion instrument data. In this preferred embodiment, the instrument database 56 is a storing device of high capacity, low cost, and low access speed, so it is not suitable to replace the instrument database 16 of the prior art in FIG. 1 and be used immediately by the synthesis module.

Then, the operation procedure of the embodiment will be described in detail in the following. First, the analysis module 52 of the wavetable audio synthesis system 40 of the present invention analyzes an inputted music file 53 from the music database 51 to generate the required data of a predetermined number (M2+P2) of instruments to synthesize the music file 53. For example, if it needs 8 melodic instrument data and 3 percussion instrument data to synthesize one specific music file 53, M2 is 8, and P2 is 3.

The judgment module 54 judges whether the required storing space of M2+P2 kinds of instrument data exceeds the predetermined capacity of the memory 60. The predetermined capacity may be storable space of the memory 60 or a predetermined specific capacity. If no, the judgment module 54 takes M2+P2 kinds of instrument data out of the instrument database 56 to be stored in the memory 60. If yes, perform an instrument replacement procedure and replace M2+P2 kinds of instrument data by another predetermined number (M3+P3) of instrument data. The total amount of M3+P3 kinds of instrument data does not exceed the predetermined capacity of the memory 60. Finally, according to the judgment, the judgment module 54 takes the required M3+P3 kinds of instrument data, while performing wavetable audio synthesis, out of the instrument database to be stored in the memory 60.

The synthesis module 66 synthesizes a digital music signal according to the instrument data stored in the memory 60 and outputs the synthesized music signal to the speaker 70 via the digital/analog converter/amplifier 68 to output the music file 53.

According to the above, the characteristic of the present invention is that the system can select the most suitable instrument data to replace the original and required instrument data of wavetable audio synthesis in accordance with the built-in memory capacity of the wavetable audio synthesis system. Therefore, how to select suitable instrument data is the focus of the present invention.

Figure 4:
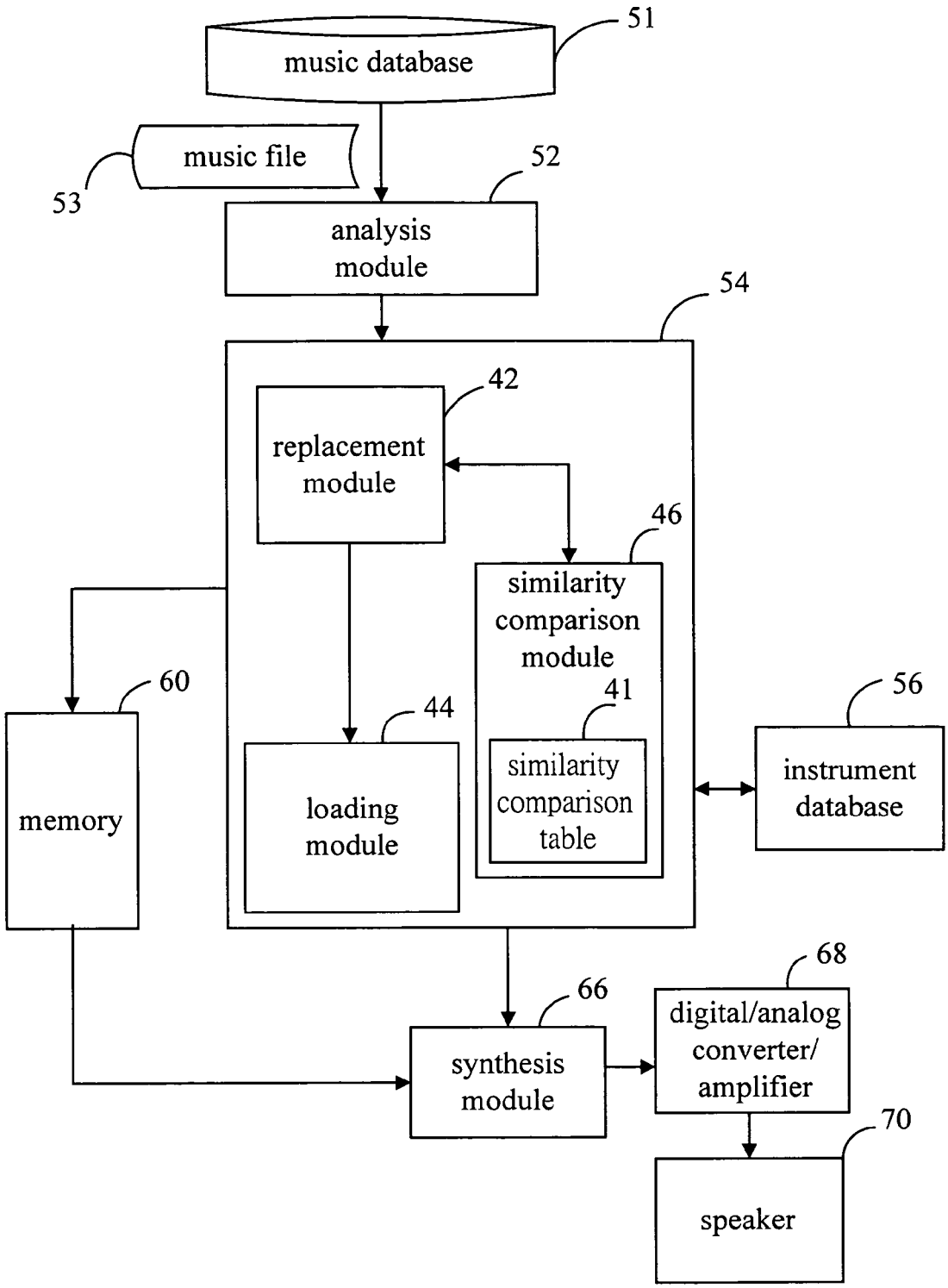
FIG. 4 shows the judgment module shown in FIG. 3.

Please refer to FIG. 4. FIG. 4 shows the judgment module shown in FIG. 3. The judgment module 54 of the present invention further comprises a similarity comparison module 46, a replacement module 42, and a loading module 44. The similarity comparison module 46 further comprises a similarity comparison table 41 for containing the similarity between the M1+P1 kinds of instrument data. The replacement module 42 is used for performing the replacement procedure of instrument types to reduce the amount of data when the amount of required instrument data exceeds the predetermined capacity of the memory 60. The loading module 44 is used for loading the required M2+P2 or M3+P3 kinds of instrument data from the external instrument database 60 into the memory 60 after confirming that the amount of required instrument data does not exceed the predetermined capacity of the memory 60.

Figure 5:
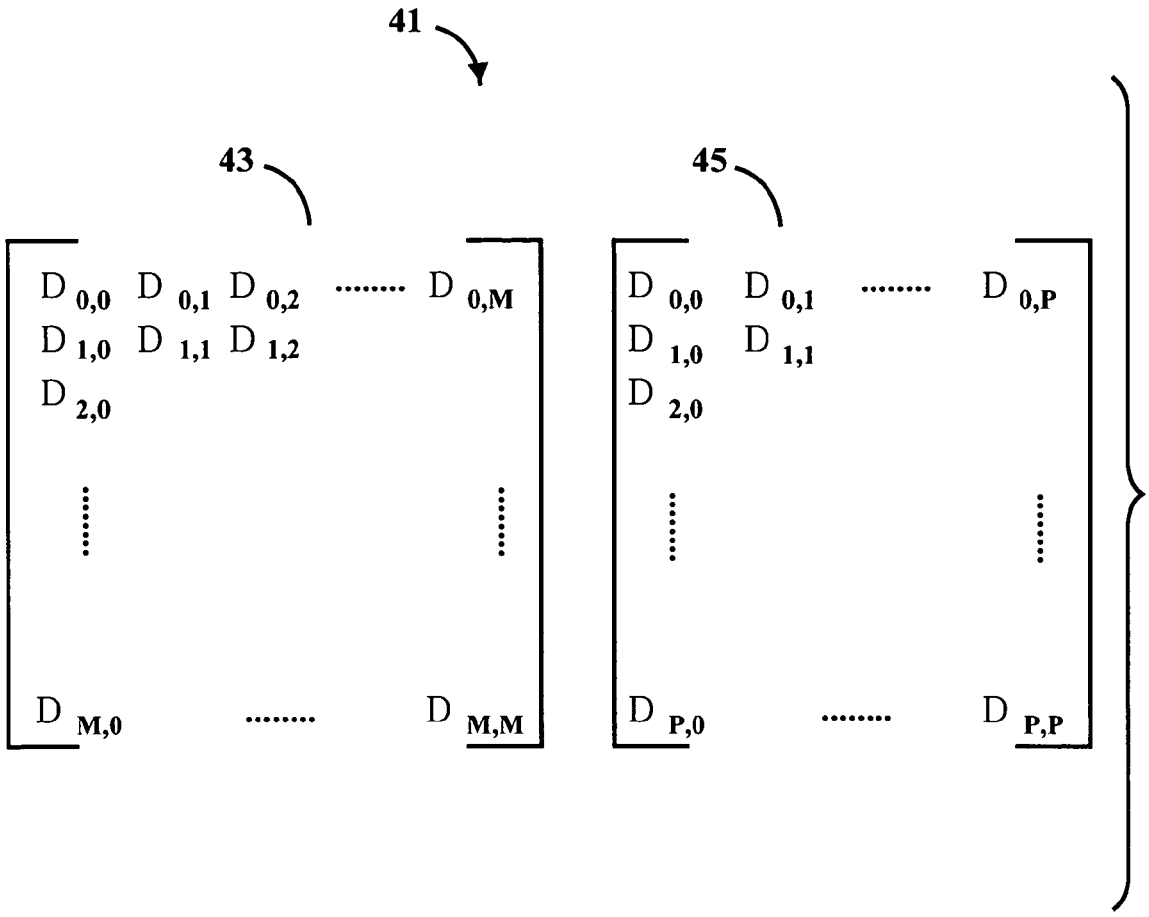
FIG. 5 shows a similarity comparison table 41 shown in FIG. 4.

Please refer to FIG. 5. FIG. 5 shows a similarity comparison table 41 shown in FIG. 4. The similarity comparison module 46 of the judgment module 54 further comprises a similarity comparison table 41 for containing the instrumental similarity value between two musical instrument data by comparing each of the M1+P1 kinds of instrument data with the other instrument data; this gives a quantification standard to the similarities between each two different instruments. The similarity comparison table 41 comprises two subtables. The table 43 sets up an M1×M1 table for M1 kinds of melodic instruments in the instrument database 56. The table 45 sets up a P1×P1 table for P1 kinds of percussion instruments. The similarity between any two instruments can be obtained immediately by looking into the similarity comparison tables. For example, the $D_{0,1}$ in table 43 represents the similarity of tones between the $1^{st}$ and $2^{nd}$ instrument, and the $D_{2,3}$ represents the similarity of tones between the $3^{rd}$ and $4^{th}$ instrument. Therefore, in e.g. $D_{0,0}$, $D_{1,1}$ . . . , the difference between the same instruments is 0. If the total amount of data of M2+P2 kinds of instruments, used for synthesizing, exceeds the predetermined capacity of the memory 60, according to the similarity comparison table 41, a pair of instruments with the lowest instrument difference (i.e. the highest instrument similarity) value can be found by sequentially searching in the M2+P2 kinds of instrument data. If the instrument similarity value between the instrument data M and N is the highest, the instrument data M is replaced with N. After performing the replacement procedure, the required instrument data has further been reduced to M3+P3 kinds of instrument data, and the total amount of data will not exceed the predetermined capacity.

Figure 6:
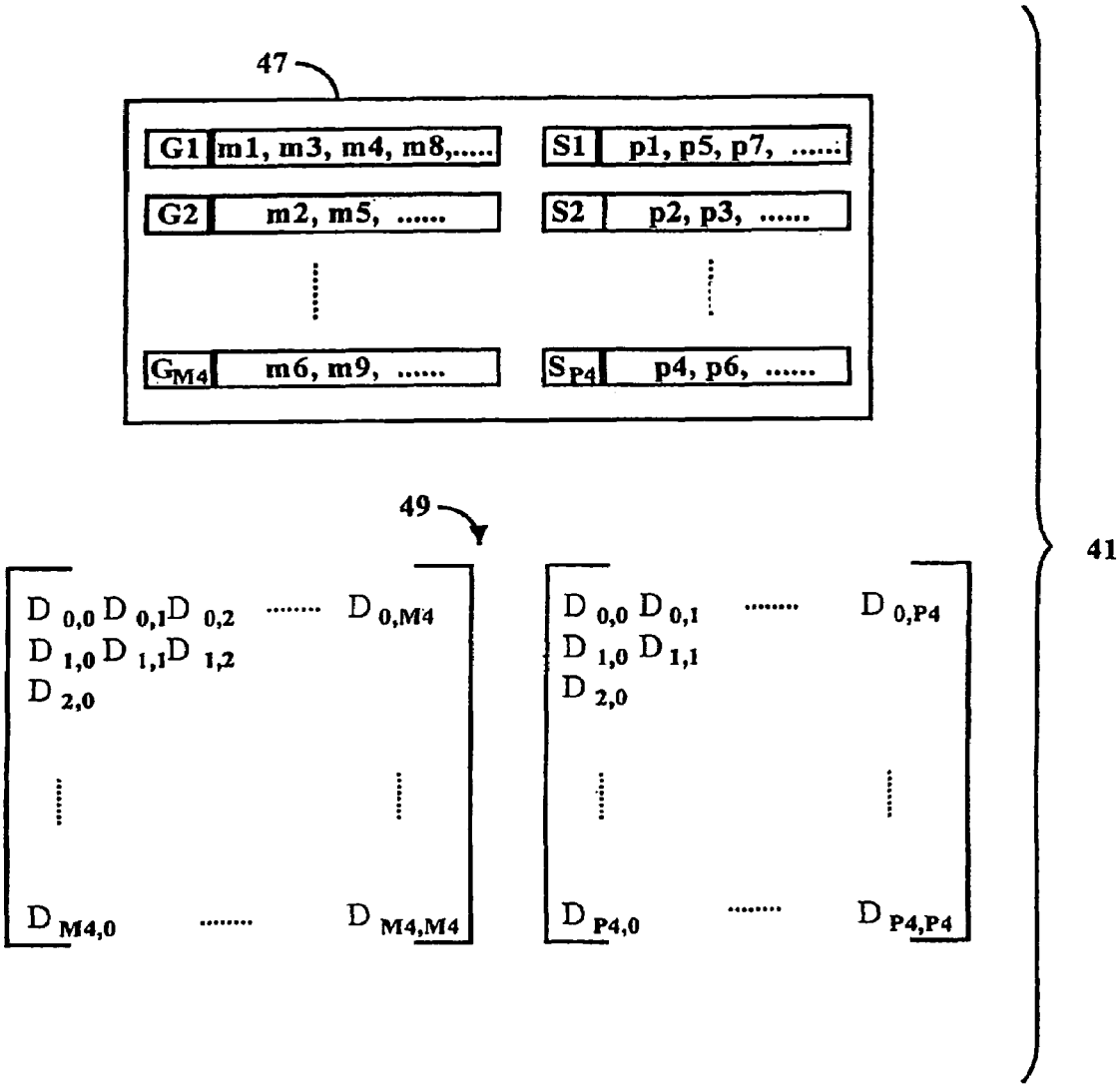
FIG. 6 shows the similarity comparison table 41 of the second embodiment shown in FIG. 4.

However, when Ml and P1 in the above similarity comparison table 41 are very large, the table is not easy to be set up and may occupy much space. For example, under the condition of having 128 kinds of melodic instruments and 47 kinds of percussion instruments, setting up one 128×128 table and one 47×47 table is necessary. Therefore, there is another embodiment described in the following. Please refer to FIG. 6. FIG. 6 shows the similarity comparison table 41 of the second embodiment shown in FIG. 4. The method of the second embodiment is to use a group table 47 and a similarity comparison table 49 in accordance with the group table 47, wherein the group table 47 is used to contain a plurality of instrument data groups (M4+P4 groups), generated by grouping M1+P1 kinds of instrument data according to similarity. As shown in FIG. 6, the group table 47 divides M1 kinds of melodic instruments into M4 groups and P1 kinds of percussion instruments into P4 groups, wherein m1, m2, m3, . . . represent the respective melodic instruments and p1, p2, p3, . . . represent the respective percussion instruments. Each instrument data group comprises plural kinds of instrument data, and one representative instrument data is utilized to represent all the different kinds of instrument data of the instrument data group. In another words, when a required instrument data belongs to the first instrument group G1, the instrument data is directly replaced by the representative instrument of the first instrument group.

If the total amount of data still exceeds the predetermined capacity after referring to the group table 47 and reducing the number of kinds of instruments, the system can further select the substitute instrument data via the similarity comparison table in accordance with the group table. As shown in FIG. 6, the similarity comparison table 49 is used for containing instrument similarity values between representative instruments of each two of the instrument groups. Because the similarity comparison table 49 only contains the similarity between two representative instruments from different instrument groups, compared to setting up the similarity comparison table of M1+P1 kinds of instruments, this kind of representative instruments similarity table is easier to be set up and occupies less space. For example, 128 kinds of melodic instruments are being grouped into 30 groups first, then 47 kinds of percussion instruments are further grouped into 10 groups; according to this group table, it only needs to set up one 30×30 similarity comparison table of melodic instruments and one 10×10 similarity comparison table of percussion instruments.

It has to be emphasized that when looking into the similarity comparison table to find out two instruments with the most similar characteristics, the instrument similarity value of instrument M to N may be different from the instrument similarity value of instrument N to M in the table. This is because in the sense of hearing, the effect of replacing instrument M by N may not be bad, but the effect of replacing instrument N by M may not be so good. Therefore, the definition of the table is flexible.

In the following, specific figures are taken as examples to explain the embodiment. After analyzing the music file 53 by the analysis module 52, it needs 8 melodic instruments ma, mb, mc, md, me, mf, mg, mh and 3 percussion instruments pa, pb, pc to synthesize the music file 53. At this time, the judgment module 54 will judge whether the 8+3 kinds of instrument data exceeds the predetermined capacity of the memory. If no, the loading module 44 of the judgment module 54 will load the 8+3 kinds of instrument data into the memory 60. If the 8+3 kinds of instrument data exceeds the predetermined capacity of the memory, the replacement module 42 is started to perform the replacement procedure. In the judgment module 54, the similarity comparison module 46 looks into the table to obtain the highest instrument similarity value by replacing mb with ma. After the replacement module 42 gives up the music data of mb, if 7+3 kinds of instrument data does not exceed the predetermined capacity of the memory, the loading module 44 accesses the 7+3 instrument data from the instrument database 56 to the memory 60, so that the synthesis module 66 can synthesize the music file 53, the melody of instrument mb is performed by the melody of instrument ma. If 7+3 instrument data still exceeds the predetermined capacity of the memory, the replacement procedure is continually performed until the total amount of the selected instrument data does not exceed the predetermined capacity.

Figure 7:
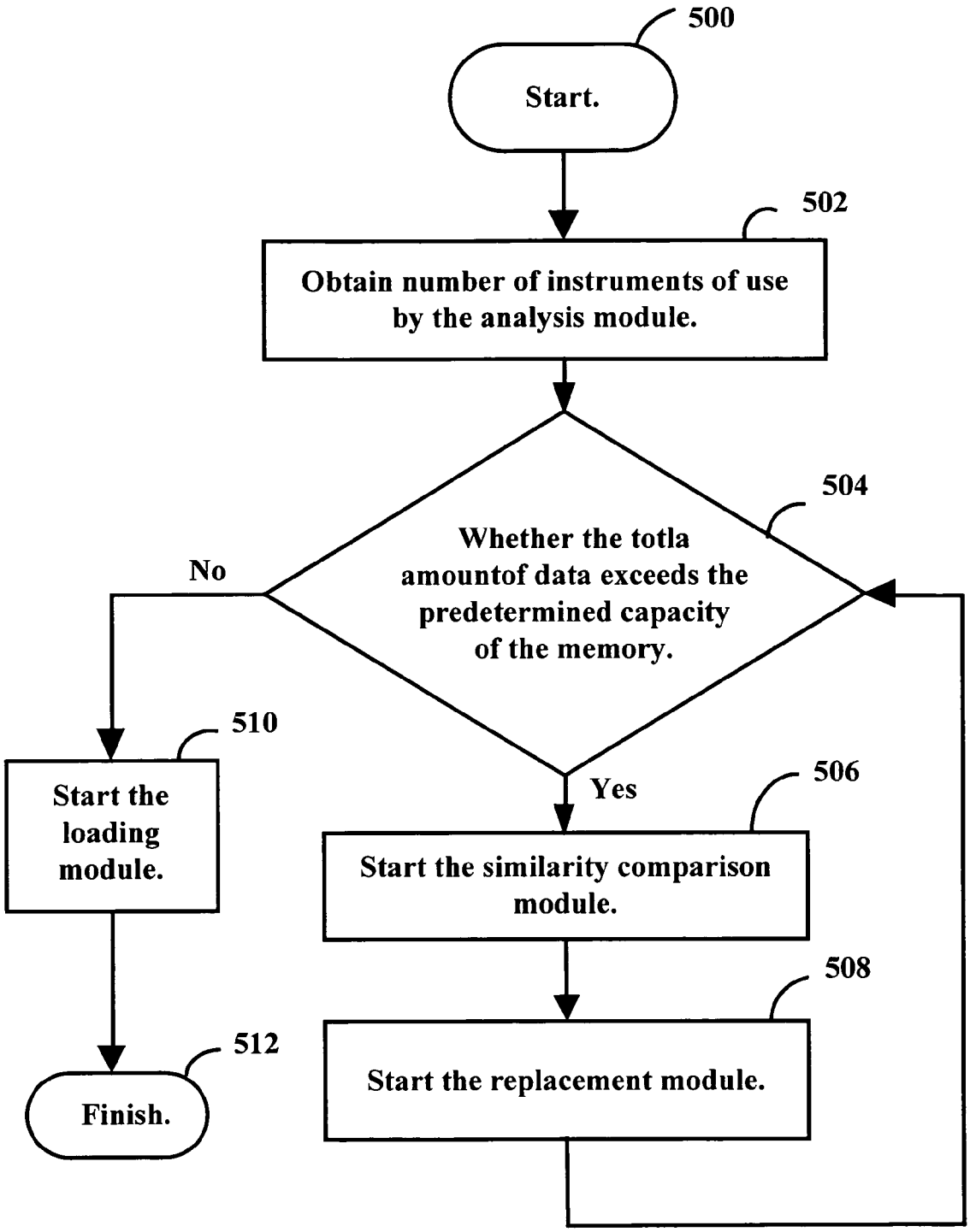
FIG. 7 is a flow chart of the instrument selecting method of the present invention.

Please refer to FIG. 7. FIG. 7 is a flow chart of the instrument selecting method of the present invention. In accordance with FIG. 5, the method comprises the following steps:

Step 500: Start.

Step 502: Obtain the number of instruments being used, (M2+P2), by the analysis module 52.

Step 504: Judge whether the required instrument data of M2+P2 kinds of instruments exceeds the predetermined capacity of the memory 60. If yes, perform step 506; if no, perform step 510.

Step 506: Start the similarity comparison module 40 to find out the most similar instruments and suitable way of replacement.

Step 508: Start the replacement module 42 to reduce the number of instrument being used and repeat step 504.

Step 510: Start the loading module 44 to load the required instrument data 62 from the instrument database 56 to the memory 60.

Step 512: Finish.

According to the above description, the present invention accesses the instrument data of the required instrument to synthesize music by the random access memory. Because of using low capacity memory, the required cost of using a large amount of memory has been reduced a lot. Furthermore, the instrument data stored in the memory may be changed randomly. The present invention selects the most similar instrument data in accordance with the required instrument of the music. Therefore, the display quality of the synthesized music is improved a lot, compared to the prior art, using the non-volatile memory (e.g. ROM) to store fixed instrument data.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An audio synthesis terminal device for performing wavetable audio synthesis, the terminal device comprising:

an instrument database for storing data of a first predetermined number of musical instruments;

an analysis module for analyzing an inputted wavetable music to generate required data of a second predetermined number of musical instruments to synthesize the wavetable music;

a memory having a predetermined capacity for storing the required data of musical instruments to synthesize the wavetable music;

a judgment module for judging weather the total amount of data of the second predetermined number of musical instruments exceeds the predetermined capacity;

if no, obtaining the data of the second predetermined number of musical instruments from the instrument database and storing the data in the memory;

if yes, performing an instrument replacement procedure, replacing the data of the second predetermined number of musical instruments by data of a third predetermined number of musical instruments, the total amount of data of the third predetermined number of musical instruments not exceeding the predetermined capacity and the third predetermined number of musical instruments being selected according to similarity between the third predetermined number of musical instruments and the second predetermined number of musical instruments; and obtaining the data of the third predetermined number of musical instruments from the instrument database and storing the data in the memory; and a synthesis module for synthesizing a digital music signal according to the instrument data stored in the memory of the terminal device.

wherein if the instrument replacement procedure is performed, every musical instrument of the inputted wavetable music that are in the second predetermined number of musical instruments is replaced by a corresponding music instrument in the third predetermined number of musical instruments during synthesizing the digital music signal so that no indication of playing musical instruments in the inputted wavetable music is directly skipped.

2. The audio synthesis terminal device of claim 1, further comprising a similarity comparison table for recording instrument similarity values between each two musical instrument data of the first predetermined number of instrument data.

3. The audio synthesis terminal device of claim 2, wherein the instrument replacement procedure comprises the following steps:

finding out sequentially an instrument data having the highest instrument similarity value with each of the second predetermined number of instrument data according to the similarity comparison table; and repeating the above step until the total amount of the searched instrument data does not exceed the predetermined capacity, and the third predetermined number of instrument data being therefore obtained.

4. The audio synthesis terminal device of claim 1, further comprising a group table for storing a plurality of instrument data groups of the first predetermined number of instrument data, wherein each instrument data group comprises a plural kind of instrument data and one representative instrument data is utilized to represent the instrument data of the instrument data group.

5. The audio synthesis terminal device of claim 4, further comprising a similarity comparison table for containing instrument similarity values between each two of the instrument data groups.

6. The audio synthesis terminal device of claim 5, wherein the instrument replacement procedure comprises the following steps:

finding out sequentially the instrument data group to which each of the second predetermined number of instrument data is classified according to the group table;

judging whether the total amount of data of the representative instrument data of the instrument data groups to which the second predetermined number of instrument data are classified does not exceed the predetermined capacity;

if yes, the third predetermined number of instrument data being thus obtained if no, finding out sequentially an instrument data group having the highest instrument similarity value with each of the instrument data groups to which the second predetermined number of instrument data are classified according to the similarity comparison table; and repeating the above steps until the total amount of the representative instrument data of all of the instrument data groups does not exceed the predetermined capacity, and the third predetermined number of instrument data being therefore obtained.

* * * * *